US010029703B2

(12) United States Patent
Arditi

(10) Patent No.: US 10,029,703 B2
(45) Date of Patent: Jul. 24, 2018

(54) SANDBOX FOR RAIL VEHICLES

(71) Applicant: Microsistemi S.r.l., Figline e Incisa Valdarno (FI) (IT)

(72) Inventor: Andrea Arditi, Castelfranco Pian di Scò (IT)

(73) Assignee: MICROSISTEMI S.R.L., Figline e Incisa (IT)

( * ) Notice: Subject to any disclaimer, the term of this patent is extended or adjusted under 35 U.S.C. 154(b) by 0 days.

(21) Appl. No.: 15/316,554

(22) PCT Filed: Jun. 9, 2015

(86) PCT No.: PCT/IB2015/054352

§ 371 (c)(1),
(2) Date: Dec. 6, 2016

(87) PCT Pub. No.: WO2015/189771

PCT Pub. Date: Dec. 17, 2015

(65) Prior Publication Data

US 2017/0144676 A1 May 25, 2017

(30) Foreign Application Priority Data

Jun. 10, 2014 (IT) ..... FI2014A0142

(51) Int. Cl.
*B61C 15/10* (2006.01)

(52) U.S. Cl.
CPC ..... *B61C 15/107* (2013.01); *B61C 15/102* (2013.01)

(58) Field of Classification Search
CPC ..... B61C 15/102; B61C 15/107; B61C 15/08; B61C 15/10

(Continued)

(56) References Cited

U.S. PATENT DOCUMENTS 1,990,253 A 2/1935 Schonig
2,324,274 A * 7/1943 Baldwin ..... B61C 15/102 291/15

(Continued)

FOREIGN PATENT DOCUMENTS

EP 0656292 A1 6/1995
FR 12138 E 7/1910

(Continued)

OTHER PUBLICATIONS

Int'l Search Report, PCT/IB2015/054352, dated Aug. 19, 2015.
Written Opinion of the International Searching Authority, PCT/IB2015/054352, dated Aug. 19, 2015.

*Primary Examiner* — Mark T Le
(74) *Attorney, Agent, or Firm* — Nancy J. Flint, Attorney at Law, P.A.; Nancy J. Flint, Esq.

(57) ABSTRACT

A sandbox for rail vehicles, of a type comprising a sand container, on the bottom of which there is a hollow body which presents one or several openings through which sand flows out towards an ejector assembly beneath by passing through an outlet hole controlled by an axially sliding vertical shutter located inside the hollow body is provided. The shutter translates between a lower position in which the output hole is closed and an upper, maximum opening position, whereby the shutter features a cylindrical shape and its lower end functionally cooperates with a ring shaped, sealing coaxial seat, corresponding to the outlet hole of the container.

18 Claims, 4 Drawing Sheets

(58) Field of Classification Search
USPC ..... 291/18, 19, 20, 21
See application file for complete search history.

(56) References Cited

U.S. PATENT DOCUMENTS

| | | | | | |
|---|---|---|---|---|---|
| 2,909,383 | A * | 10/1959 | Nanfeldt | B60B 39/10 | 291/23 |
| 4,813,481 | A * | 3/1989 | Sproul | E21B 34/063 | 137/527.8 |
| 5,451,824 | A * | 9/1995 | Sieber | F16K 31/04 | 310/20 |
| 2006/0131891 | A1 * | 6/2006 | Mandel | B60B 39/025 | 291/2 |

FOREIGN PATENT DOCUMENTS

| | | | |
|---|---|---|---|
| FR | 503410 | A | 6/1920 |
| FR | 593382 | A | 8/1925 |
| WO | 2010031831 | A1 | 3/2010 |
| WO | 2013034816 | A1 | 3/2013 |

* cited by examiner

SANDBOX FOR RAIL VEHICLES

TECHNICAL FIELD

The present invention belongs to the sector of the accessory devices of rail vehicles; specifically, the sandboxes, i.e. those containers whose function is to contain and release sand or another material on a controlled manner so as to improve the grip of the wheels on rails.

STATUS OF THE ART

A sandbox for rail vehicles is a device used to contain sand, or another powdered abrasive material, and to deliver it, upon a command, between wheels and rails in order to increase friction and reduce the risk that wheels skid, instead of rotating around the point of contact on the rails.

In general sandboxes comprise a sand container inside which a valve assembly is connected on the bottom to control the transfer of sand to a delivery pipe. In the known art the latter is often heatable, to prevent ice from forming internally thereto, because of the humidity of sand, which would make it difficult for sand to come out.

The valve assembly is usually made up of a shutter comprising a stem sliding along its own axis, whose properly shaped lower end opens and closes a delivery hole present in the lower part of the container.

In most cases the stem slides inside a hollow body, located inside the container and including a number of passageways through which sand penetrates it.

Shutter driving is operated by appropriate control means of different types, which modulate the amount of sand going out; the most popular actuators are of electromagnetic or pneumatic types.

Unfortunately the control means used so far in the sandboxes do not control the translatory motion of the shutter continuously, but rather they just open and close it completely, without any choking.

More complex systems, like those dedicated to the operation of high-speed rail vehicles, control the overall delivery by varying the frequency of the on/off cycles of the shutter.

Sand descent and jet are provided by a pneumatic system which, outside the container, speeds up the sand coming out of the valve assembly, so as to impart such a speed to it as to reach the final destination.

A good adjustment of the outgoing sand flow is therefore an important feature of railway sandboxes and it is made difficult by the presence of grains, which prevent a complete closing of the valve assembly and also cause an untimely wear thereof.

Different solutions are known: EP 1312488 A2 discloses a solution of the on/off type, with no intermediate positions, with a shutter controlled by an electromagnet.

In DE 29721340 the delivery hole is opened and closed by a bulb shutter associated with a truncated-cone shaped seat tapered downwards. However the correct closing of a shutter like this can be prevented by grains of sand which, during the closing operation, remain trapped between the shutter itself and the truncated-cone shaped seat.

Patent application FR 593382 A describes a compressed air sandbox for rail vehicles comprising a shutter, located below the outlet hole and controlled by a piston, which moves from an upper closed position down to a lower opened position.

Patent application WO 2010/031831 A1 describes a sandbox comprising a shutter element, located below the outlet hole, which allows sand to move toward the outlet conduit or to block its flow. Such element is integral with a rod driven by an electromagnet which is located near to the opening, submerged into sand. This device operates between an upper closed position and a lower opened position. Solutions like those disclosed in WO 2010/031831 A1, FR 593382 A or even in IT 1337388 specify the use of a shutter with a closing plate or cone located outside the delivery hole: this functional scheme is such that the actuator, upon closing, bears the weight of the sand located above the plate of the container and, upon opening, makes it difficult to control the flow of sand. These problems are solved by the special configuration of the sandbox according to the present patent application, as it will be apparent upon reading the following text.

Document EP 0656292 A1 describes a sandbox comprising a shutter operated by a pressurized fluid. The shutter is movable between an upper opened position and a lower closed position; the outlet hole is located in a specifically designed seat cut below an abutting element having concavity facing the tank, which cooperates with a shutting element carried by the end of the lower head of the piston. The abutting seat thus results from the contact of the bottom plate of the shutter, which is circular, with the conical surface of the abutting element.

In the embodiments described in patent application FR 503410 A the shutters rotate with respect to an axis that crosses the tank of the sandbox: in a version, the axis of the shutter is close to the outlet holes, whereas in the other one it is close to the upper base of the tank.

Document WO 2013/034816 A1 is related to a sandbox comprising a special pulsed motion shutter, which prevents any contact between the stored sand and the external air. Such feature is achieved by adopting a specially designed overflow volume which never brings the tank to a direct communication with the outlet conduit, thanks to the appropriate vertical translatory movement of a pulsed motion element that does not abut.

Almost all of the above described solutions adjust the sand flow through a sequence of openings and closings, also referred to as pulsations, whereby never can the flow be constant; also, an impulsive and discontinuous adjustment, of the on/off type, results in a greater wear of the control components of the shutter, because of their scrapings as well as of the short and repeated cycles they are subjected to.

PURPOSES AND SUMMARY OF THE INVENTION

A purpose of the present invention is to improve the sand flow adjustment system so as to make it possible to easily dose it via a control system.

Said purpose is achieved by a shutter featuring a perfectly cylindrical shape whereby, in its vertical motion, even though submerged into the sand, it does not undergo any hindering effect forced by the sand itself both during the ascending step, in that it does not move any mass, nor during the descending step, in that its movement goes with the sand that falls downwards not only by gravity but also because of the air flow caused by the vacuum generated by the expulsion air jet below the shutter.

Advantageously, a particularly effective embodiment comprises a spreader element which injects compressed air into the tank, close to the shutter, in order to dry and make the sand flow more fluid.

In a particularly complete embodiment the sand inside the tank can be heated by a heating device which performs an antifreezing and drying function.

A further purpose of the present invention is to impart a greater reliability and ease of maintenance to the sandbox, while also making it easier to disassemble the container.

DETAILED DESCRIPTION OF AN EMBODIMENT OF THE INVENTION

Figure 1:
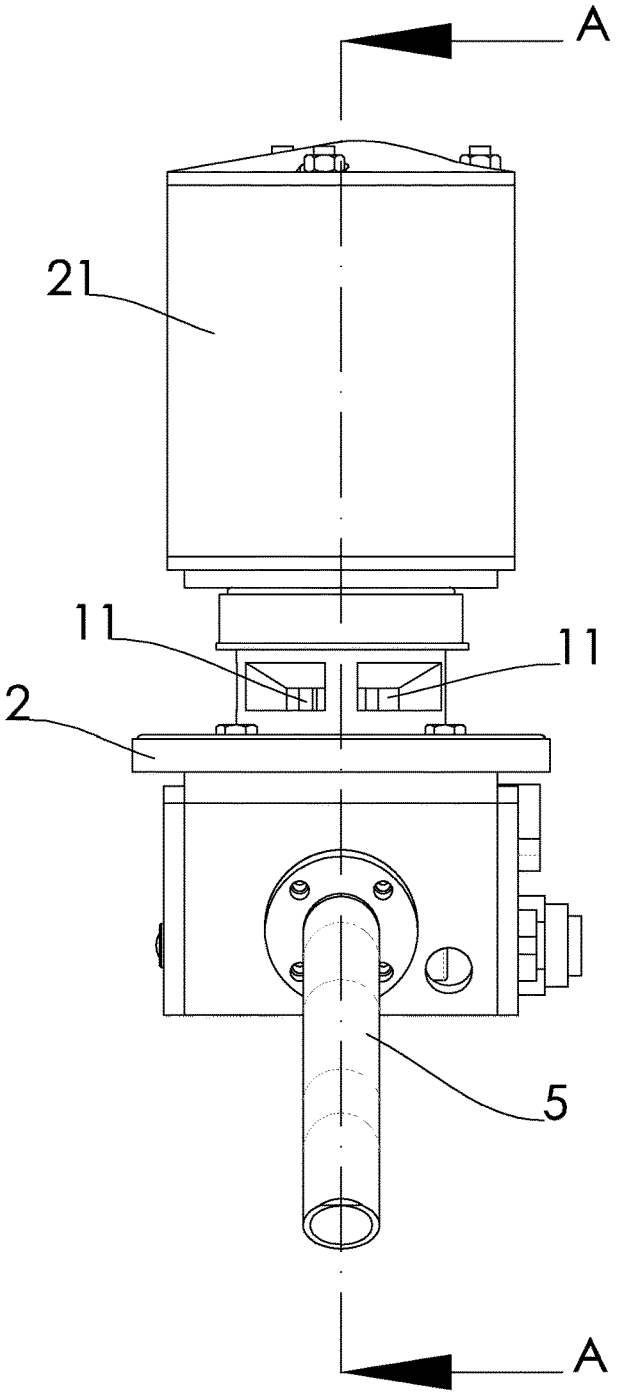
FIG. 1 shows a front view of an embodiment of the sandbox according to the present patent application, wherein one can identify a box-shaped body (21) that will be submerged inside the sand tank and sand will flow by passing first through the openings (11), the hole cut in the flange (2), and then the delivery pipe (5). The figure also shows the track of the cutting plane A-A of the cross-sections shown in FIGS. 4 and 5.

The following detailed description, which is merely made for explanatory not limitative purposes, with reference to the attached drawings, highlights the further features and the advantages resulting therefrom and that are an integral part of the subject invention.

The sandbox according to the present patent application comprises a container (1) in the lower part of which there is a dispenser device which continuously adjusts the sand flow through an outlet hole up to an ejector assembly (3) underneath, from which the sand is sent to its destination via a delivery pipe (5).

The advantages described above are achieved thanks to the presence, inside said dispenser device, of an axially sliding, cylindrical vertical shutter (15), whose lower end (151) functionally cooperates with a ring-shaped sealing seat.

According to a particularly effective embodiment, said sealing seat is implemented by using a ring (23) made of an elastomeric material, whose inner diameter substantially coincides with the outer diameter of the shutter (15), so as to guarantee sand-tightness.

This solution, besides being extremely advantageous in terms of ease of maintenance, also provides the surprising advantage of facilitating the ejection of the grains of sand that are possibly trapped between the shutter (15) and the ring (23).

Further advantages are obtained by imparting a concave shape to the lower face of said shutter (15), so that said end (151) determines a projecting perimetric ridge which, by functionally cooperating with said ring (23), practically prevent big-size grains from remaining trapped between the shutter (15) and the ring (23) during the closing operation, in that, also thanks to the elasticity of the latter, the grains are unloaded downstream into the ejector assembly (3) underneath.

Said shutter (15) is accommodated inside a hollow body (10) whose lateral surface has one or several openings (11) through which sand flows towards the outlet hole underneath.

Said shutter (15) generally moves along a vertical axis, from an upper maximum-opening position down to a lower closed position wherein the end (151) is completely set inside the ring (23).

Specially designed handling devices of a known type, usually electromechanic or pneumatic ones, are used to drive the shutter's movements.

According to a simple and practical embodiment said handling devices are contained in a box-shaped body (21) superimposed to said hollow body (10) and are capable of continuously adjusting the position of the shutter between the two extreme, closed and maximum opening positions, so as to accurately determine the flow of sand towards the ejector assembly underneath.

The upper end (152) of the shutter (15) slides inside said hollow body (10), through a guide bush and a dust seal. In a preferred embodiment, the adjustment of the sand flow is implemented by a stepping motor comprising a hollow shaft and a ring nut which provides for its axial translatory movement via a threaded stem integral with the shutter (15). In order for such driving to take place, the axial rotation of the shutter (15) shall be prevented by the sliding movement of a pin (153), radially projecting from the shutter, engaging a low-friction slot (8) cut in a guide bush of the shutter.

In a particularly effective embodiment, a drilled flange (2) is coaxially interposed between the hollow body (10) and the ring (23) underneath; very conveniently is this flange drilled in such a way as to define a truncated cone, whose longer base is up, so as to form a funnel and thus facilitate the adjustment of the amount of sand that flows through in the various intermediate positions of the shutter (15).

Said drilled flange (2), being located outside the container (1), supports said ejector assembly which, in the embodiment depicted in the figures, in the region below said ring (23) comprises a hopper (6) which is in communication with said final delivery pipe (5) via a Venturi (4) tube. A nozzle (9) injects compressed air so as to push the sand from the container towards the outlet.

In the embodiments depicted in the drawings of the present patent application, the drilled flange (2) is interposed between the container (1) and the remaining elements so as to make the assembling and disassembling operations, also for maintenance purposes, easy.

Conveniently inside said box-shaped body (21) one or several solenoid valves (18, 19) can be accommodated. For instance, the valve (18), which is an electrically-controlled pneumatic valve, controls the compressed air inlet to the ejector assembly (3), whereas the valve (19), which is also an electrically-controlled pneumatic valve, controls the spreader element (14). The latter element is preferably made of a porous material and blows the compressed air into the sand inside the container (1) to implement the previously mentioned fluidization and drying functions; such functions can be made easier by the presence of appropriate heating systems inside the container (1), for instance electrical resistors, interfacing to appropriate electrical and electromechanical temperature sensing devices used to control it and to prevent the sandbox from overheating.

Advantageously can such heating systems be accommodated in the base of the box-shaped body (21) which, being usually made of a metal material, preferably aluminum, rapidly gives off heat to the remaining elements of the sandbox and to the sand itself.

Figure 2:
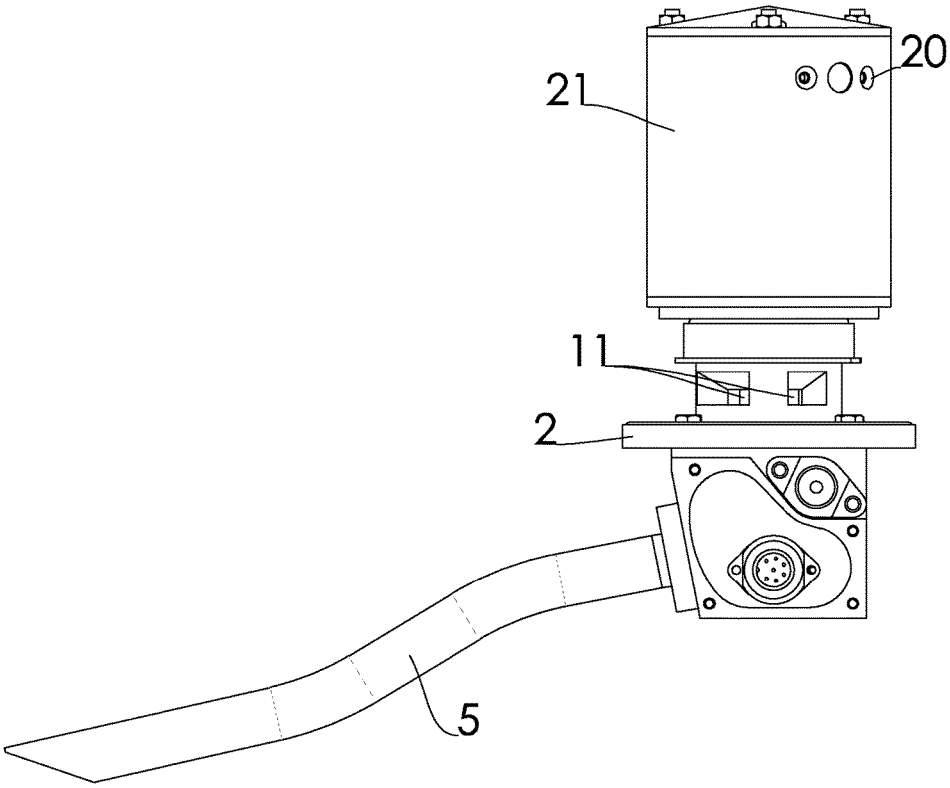
FIG. 2 shows a side view of the sandbox depicted in the previous figure. In the upper part of the box-shaped body (21) there are a number of openings (20) which make it possible the operation of a minimum sand level sensor.
Figure 3:
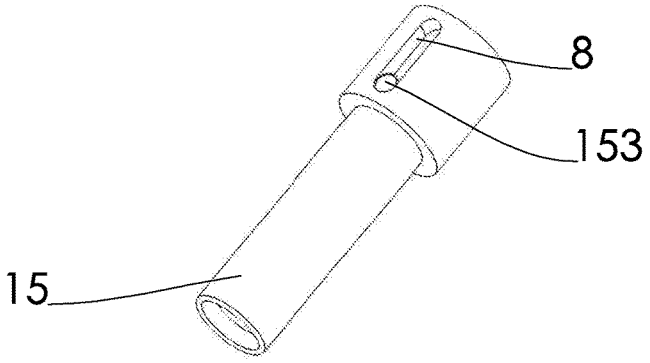
FIG. 3 shows an axonometric view of an embodiment of the shutter (15) provided with a pin (153) which slides into a slot (8) cut in a bush, so as to prevent it from rotating.
Figure 4:
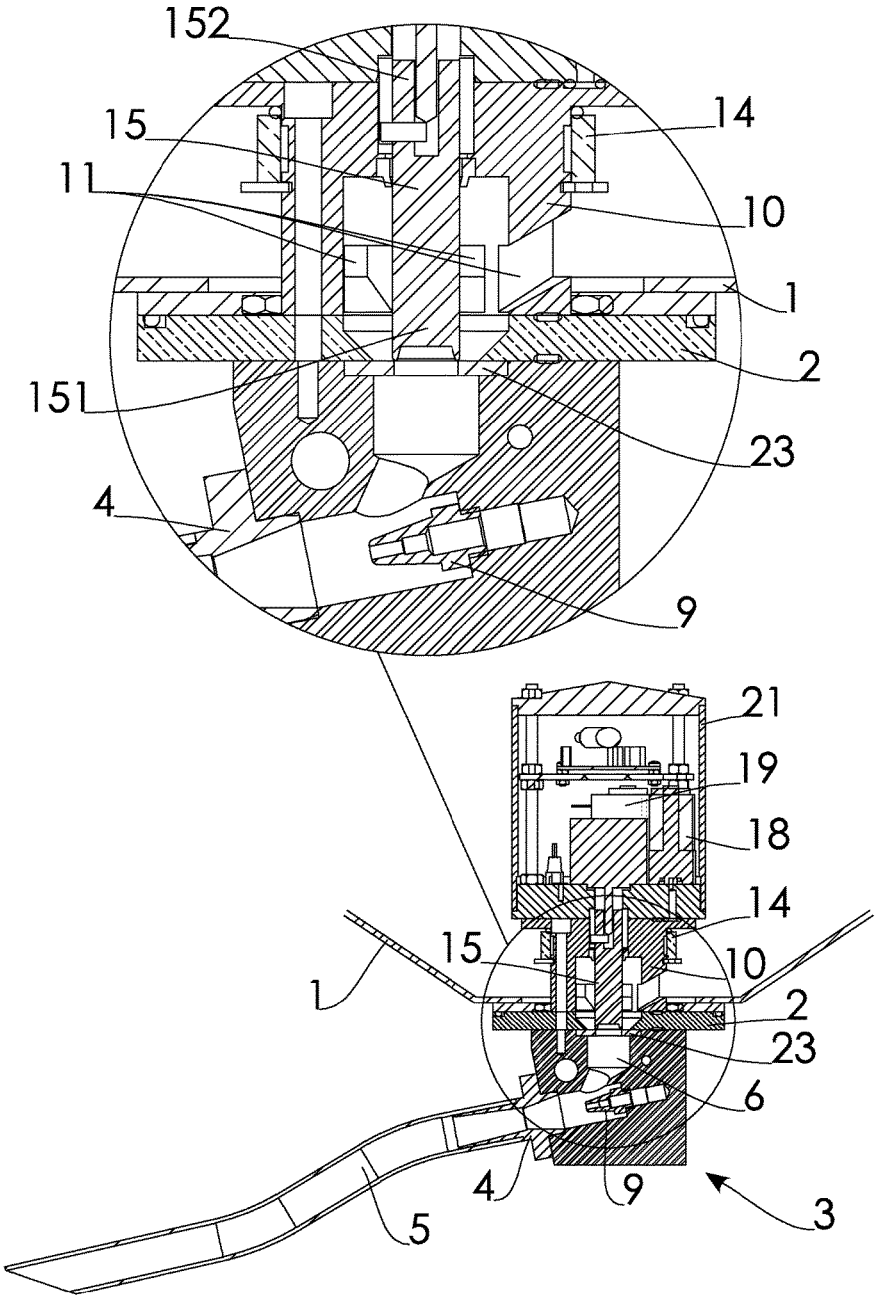
FIG. 4 shows a cross-sectional view of FIG. 1, complete with a detail, the shutter (15) being set to its closed position, i.e. its lower end (151) being set against the ring (23). Conversely, the upper end 152) is connected to the handling devices. The figure also shows the container (1) of the sand tank connected to a drilled flange (2), an ejector assembly (3), a Venturi tube (4), a delivery pipe (5), a hopper (6), a nozzle (9), two solenoid valves (18, 19), and the box-shaped body (21). The figure also shows the spreader element (14), i.e. a torus featuring a rectangular section made of a porous material, for instance synthesized bronze, which surrounds a hollow body (10).
Figure 5:
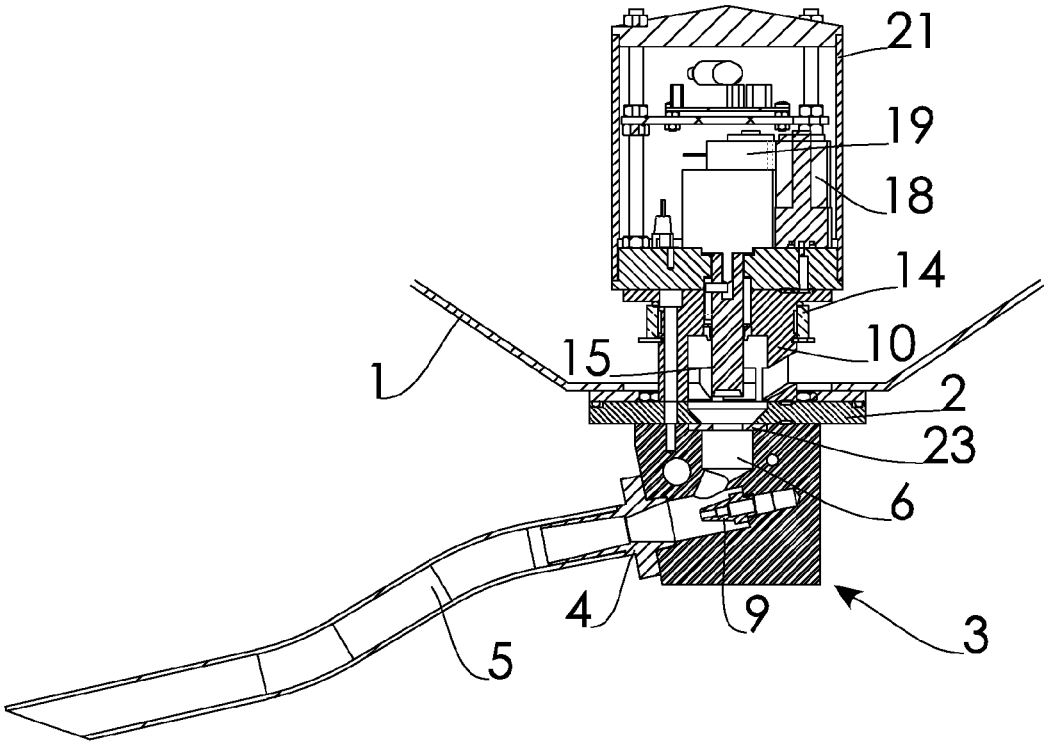
FIG. 5 shows the same cross-section as that shown in FIG. 4, the shutter (15) being set to its opened position, i.e. a position whereby the lower end is raised with respect to the ring (23).

In a particularly advantageous embodiment, the electronic control system, the handling devices, and the actuation devices are mounted inside the box-shaped body (21). A similar solution is particularly compact and features important advantages in terms of response times and in optimizing air consumptions. Conveniently can the ejector assembly (3) be equipped, as shown in FIG. 2, with connectors for compressed air and electric power provisioning purposes, in addition to the rail vehicle control systems, if any.

The invention claimed is:

1. A sandbox for rail vehicles, comprising a sand container, on the bottom of which there is a hollow body which presents one or several openings through which sand flows out towards an ejector assembly beneath by passing through an outlet hole controlled by an axially sliding vertical shutter located inside said hollow body and means handling and controlling said shutter which cause its translation between a lower position in which said outlet hole is closed and an upper, maximum-opening position, characterized in that said shutter features a cylindrical shape and its lower end functionally cooperates with a ring shaped, sealing coaxial seat, corresponding to said outlet hole of said container wherein said ring-shaped sealing seat is realized by using a ring made of an elastomeric material whose inside diameter corresponds to the outside diameter of said cylindrical shutter, wherein further said lower end of said cylindrical shutter features a concavity facing downwards which determines a projecting perimetral relief which functionally cooperates with said ring.

2. A sandbox for rail vehicles according to claim 1, characterized in that said handling and control means are able to make said shutter stop in a plurality of different positions, intermediate between said lower closing position and said upper maximum-opening position.

3. A sandbox for rail vehicles according to claim 2, characterized in that said handling and control means comprise a hollow shaft stepping motor with a nut screw which determines the translation of said shutter via a threaded stem integral with the latter and in which the rotation of said shutter is prevented by a radially projecting pin which engages a longitudinal slot obtained in a guide bush of said shutter.

4. A sandbox for rail vehicles according to claim 3, characterized in that said ring-shaped sealing seat comprises a drilled flange coaxially interposed between said shutter and said ring.

5. A sandbox for rail vehicles according to claim 4, characterized in that the drilling of said drilled flange comprises the shape of a truncated cone, the major base being up, and said drilled flange is coupled with said container via detachable connections means.

6. A sandbox for rail vehicles according to claim 1, characterized in that said ring-shaped sealing seat comprises a drilled flange coaxially interposed between said shutter and said ring.

7. A sandbox for rail vehicles according to claim 1, characterized in that said handling and control means are able to make said shutter stop in a plurality of different positions, intermediate between said lower closing position and said upper maximum-opening position.

8. A sandbox for rail vehicles according to claim 7, characterized in that said handling and control means comprise a hollow shaft stepping motor with a nut screw which determines the translation of said shutter via a threaded stem integral with the latter and in which the rotation of said shutter is prevented by a radially projecting pin which engages a longitudinal slot obtained in a guide bush of said shutter.

9. A sandbox for rail vehicles according to claim 1, characterized in that said ejector assembly comprises a hopper located below said ring, under which a nozzle blows air which pushes the sand through a Venturi tube well inside a delivery pipe and said delivery pipe laterally goes out of said ejector assembly.

10. A sandbox for rail vehicles according to claim 1, characterized in that it further comprises a spreader element through which air is blown inside the container, near to said openings.

11. A sandbox for rail vehicles according to claim 1, characterized in that it further comprises a sand heating system located inside a box-shaped body superimposed to said hollow body.

12. A sandbox for rail vehicles according to claim 1, characterized in that said handling and control means are able to make said shutter stop in a plurality of different positions, intermediate between said lower closing position and said upper maximum-opening position.

13. A sandbox for rail vehicles according to claim 12, characterized in that said handling and control means comprise a hollow shaft stepping motor with a nut screw which determines the translation of said shutter via a threaded stem integral with the latter and in which the rotation of said shutter is prevented by a radially projecting pin which engages a longitudinal slot obtained in a guide bush of said shutter.

14. A sandbox for rail vehicles according to claim 1, characterized in that said ring-shaped sealing seat comprises a drilled flange coaxially interposed between said shutter and said ring.

15. A sandbox for rail vehicles according to claim 14, characterized in that the drilling of said drilled flange comprises the shape of a truncated cone, the major base being up, and said drilled flange is coupled with said container via detachable connections means.

16. A sandbox for rail vehicles according to claim 1, characterized in that said ejector assembly comprises a hopper located below said ring, under which a nozzle blows air which pushes the sand through a Venturi tube well inside a delivery pipe and said delivery pipe laterally goes out of said ejector assembly.

17. A sandbox for rail vehicles according to claim 1, characterized in that it further comprises a spreader element through which air is blown inside the container, near to said openings.

18. A sandbox for rail vehicles according to claim 1, characterized in that it further comprises a sand heating system located inside a box-shaped body superimposed to said hollow body.

* * * * *